United States Patent [19]

Perotto et al.

[11] 4,365,243

[45] Dec. 21, 1982

[54] INTERFACE DEVICE FOR THE ENTRY OF DATA INTO AN INSTRUMENT OF SMALL VOLUME RESPONSIVE TO BODY MOVEMENT

[75] Inventors: Jean-Felix Perotto, Hauterive; Christian Piguet, Neuchatel, both of Switzerland

[73] Assignee: Societe Suisse pour l'Industrie Horlogere Management Services S.A., Bienne, Switzerland

[21] Appl. No.: 217,079

[22] Filed: Dec. 16, 1980

[30] Foreign Application Priority Data

Dec. 20, 1979 [CH] Switzerland ..... 11299/79

[51] Int. Cl.[3] ..... G09G 3/00

[52] U.S. Cl. ..... 340/712; 340/365 VL; 340/706; 340/365 C

[58] Field of Search ..... 340/711, 712, 365 C, 340/365 VL, 706

[56] References Cited

U.S. PATENT DOCUMENTS

| | | | |
|---|---|---|---|
| 4,005,400 | 1/1977 | Engdahl | 340/365 R |
| 4,221,975 | 9/1980 | Ledniczki et al. | 340/365 C |
| 4,242,676 | 12/1980 | Piguet et al. | 340/712 |
| 4,264,903 | 4/1981 | Bigelow | 340/365 C |
| 4,291,303 | 9/1981 | Cutler et al. | 340/711 |
| 4,302,011 | 11/1981 | Pepper, Jr. | 340/365 C |

FOREIGN PATENT DOCUMENTS

| | | |
|---|---|---|
| 2848663 | 5/1979 | Fed. Rep. of Germany . |
| 2855935 | 7/1979 | Fed. Rep. of Germany . |
| 102167 | 11/1974 | Switzerland . |
| 2019049 | 10/1979 | United Kingdom . |
| 2019052 | 10/1979 | United Kingdom . |

*Primary Examiner*—Marshall M. Curtis
*Attorney, Agent, or Firm*—Griffin, Branigan & Butler

[57] ABSTRACT

The invention concerns an interface device for the entry of data into an instrument of small volume such as a timepiece and comprises a static touch responsive sensor formed by a plurality of juxtaposed electrodes. An electronic logic circuit on the one hand receives signals emitted by the sensor representing the position of a finger on the sensor and on the other hand provides output clock pulses to a first and a second counter. Switching means in the electronic logic circuit enable the switching of the clock pulses to the first counter if the finger is moved over the sensor at a speed $v_1$ less than a threshold speed $v_2$ or to the second counter if the finger is moved over the sensor at a speed $v_3$ greater than the threshold speed $v_2$. The invention may be employed in small timepieces for time setting for example.

13 Claims, 5 Drawing Figures

INTERFACE DEVICE FOR THE ENTRY OF DATA INTO AN INSTRUMENT OF SMALL VOLUME RESPONSIVE TO BODY MOVEMENT

BACKGROUND OF THE INVENTION

This invention comprises an interface device for the entry of data into an instrument of small volume such as a timepiece comprising a static touch responsive sensor arranged to be manually actuable with each position of a finger corresponding to at least one symbol which may take the form of a number, letter or special sign, the sensor being formed by the juxtaposition of N electrodes adapted to provide at least N−1 coded information items representative of the position of the finger on the sensor.

The invention relates to U.S. patent application No. 968,917 filed 13th December 1978 and allowed May 1980, and which concerns an interface device for data entry for small volume instruments and for which it comprises a particularly interesting improvement above all in view of its application to timepieces. The above cited application starts with the idea of a data entry device capable of being manually actuated and furnishing information representative of the position of a finger on a sensor, (resistive or capacitive), such information being independent of the width of the finger. To arrive at such a result use has been made of a sensor formed by the juxtaposition of a plurality of identical electrodes providing at their output information according to a binary code representing the position of the finger on the sensor.

The cited system may already provide an important improvement in the case where it is employed for the correction of a timepiece having an electro-optic display. Taking as an example a situation where the timepiece includes in addition to the main display of the normal timekeeping operation which appears permanently, a secondary display which may sequentially display a count-down timer, an alarm timer, a diary, a time zone, a date, etc.. All these several functional modes may be indicated by permanent signs engraved or transfered onto the interior surface of the glass. The touch sensitive key described in the above cited application may initially be employed to select the functional mode or programme. By moving the finger on said key a symbol is also moved which for instance may frame one of the permanently fixed signs and thus one may select the programme chosen when the finger is removed from the key. Should one then actuate a pushbutton the display corresponding to the programme as chosen will be transfered into the correction mode, this being indicated by blinking of the display. The correction may again be made by the touch sensitive key. If the display chosen includes a digit or a group of two digits for instance such may be augmented by moving from left to right the finger over the sensor, or diminished by the same movement but from right to left. If the number to be corrected is that of the minutes of a main display for instance, it will be appreciated that relative to known systems of correction by means of a pushbutton the cited device may enable attainment much more rapidly of the required correction, in the case where the timepiece has advanced several minutes since it will be sufficient to move the finger from right to left over a short distance in order to diminish the number and thus to bring it to the value of the timing signal.

The time indications displayed by a timepiece generally include not one but rather two groups of associated digits. The principal display of normal time of day comprises at least the indication of minutes and hours. On the auxiliary display there may appear an alarm time or a time zone of which the first digit group may indicate the hour and the second group the minute. Also there may appear on this display a diary for which the first group may indicate the month and the second the date. In a different mode or programme the same basis is provided for display of the day of the week and of the date which may appear simultaneously. If the watch is provided with a count-down timer, the latter may indicate a lapse of time comprising associated indications of hours and minutes which it must count-down. For each of the timing indications mentioned above it is necessary to foresee two correction modes, the first acting for instance on the group of numbers or digits to the left and the second on the group to the right. In known watches the changing of a correction mode from one timing to another and from one group to the other for each timing indication is accomplished by means of a pushbutton as has been mentioned in the preceding paragraph, this requiring thus a multiplicity of actuations of the pushbutton and thereby a succession of tedious operations.

The present invention proposes to overcome the above mentioned difficulties through correcting as a group each timing indication and the digit groups of which it is composed without the necessity of changing the correction mode for each of the groups one after the other. It takes advantage of the fact that the finger may be displaced at different speeds on the sensor and that means may be employed in order that by slow motion one group may be corrected and that through a rapid motion another group may be corrected.

The device of this invention and the means employed for the realisation thereof are defined in the claims hereto attached.

DETAILED DESCRIPTION OF THE DRAWINGS

Figure 1:
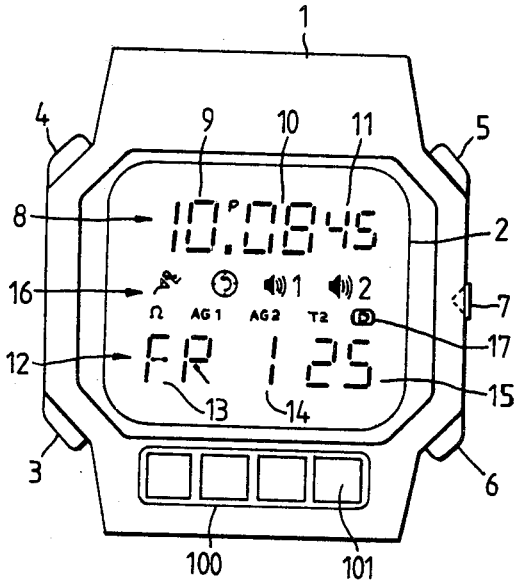
FIG. 1 is a top view of a timepiece in a first functional mode according to the invention.

FIG. 1 is a top view of the timepiece in a first functional mode according to the invention. It comprises a case 1 in which are mounted an electronic module for which one will note the display 2, a plurality 3, 4, 5, 6 and 7 of pushbuttons and a sensor 100 formed from four electrodes 101 which are identical and juxtaposed side by side. The display 2, which may be formed from liquid crystal means comprises in addition to the permanent display 8 of the normal time of day comprising three groups of two digits displaying hours 9, minutes 10 and seconds 11, an auxiliary display 12 which may display for instance the day of the week 13, the month 14 and the date 15. Signs 16 permanently fixed for instance by transfer under the watch glass may signal the functional modes which are possible, and to which one may switch the secondary display. For instance the sign A G 1 signifies diary 1 and the sign D the date. A frame 17 formed from liquid crystals may signal in which mode the arrangement is operating. It will now be described how the time setting is effected for the main display, how the functional mode is selected and how new data may be introduced into the secondary display.

Time setting

The time may be corrected if for one reason or another the main display 8 has advanced or is running slow relative to the standard time signal and also at the time of changing of the energy source of the watch. With the point of a ball-point pen a short duration pressure will be applied to pushbutton 7. This actuation causes the seconds indicating group of digits 11 to blink, thus signalling that the correction mode has been entered for this group. At this moment a single application of the finger to any portion of the sensor 100 will reset the seconds to 0. Such application should coincide with the return to 0 to the seconds of the time signal. Following thereafter the pushbutton 6 will be actuated which has as its effect initially to stop the blinking of the group 11 then to cause the groups 9 and 10 (hours and minutes respectively) to blink together. These two groups will then be found in the correction mode.

In order to correct the group 10 alone and in accordance with the invention, the finger will be moved over the sensor 100 at a first speed $v_1$ less than a threshold speed $v_2$. It is necessary to observe that from the moment that the finger comes in contact with the sensor the display will cease blinking thus facilitating the correction to be effected. The digits will be augmented if the finger is moved from left to right over the sensor and diminished if the finger is moved in the reverse sense. Since the sensor has a limited number N of electrodes (four in the example) it will not be possible to add or to remove in a single motion of the finger over the sensor more than $2N-1$ units form the displayed number (seven in the example). As may be seen from the cited patent application if it is necessary to modify the displayed number by more than $2N-1$ units it will be sufficient to lift the finger when it attains the end of the sensor and to repeat the operation starting from the other end and so on. As soon as the desired number has been attained the finger will be removed from the sensor, this having as consequence to freeze the last digit attained.

The correct only group 9 and in accordance with the invention one will move the finger over the sensor 100 as a speed $v_3$ greater than the threshold speed $v_2$. As in the case of the preceding group the figures will be augmented if the finger is moved from left to right and diminished if the opposite sense is employed. Although it is theoretically possible at speed $v_3$ as in the case of speed $v_1$ as previously examined to modify the number displayed by $2N-1$ digits through running over the entire sensor, numerous trials have shown that a discrimination based entirely on the difference in speed was not sufficiently certain and that it was necessary to take into account differences in speed which occur along the route while the finger is moving over the sensor. For this reason in order to correct group 9 and in accordance with the preferred variant of the invention it is necessary not only to traverse the sensor at speed $v_3$ but initially to touch the first electrode and to leave the last at a speed substantially equal to said speed $v_3$ in order to add or subtract a single unit from the number of the hours.

Figure 3:
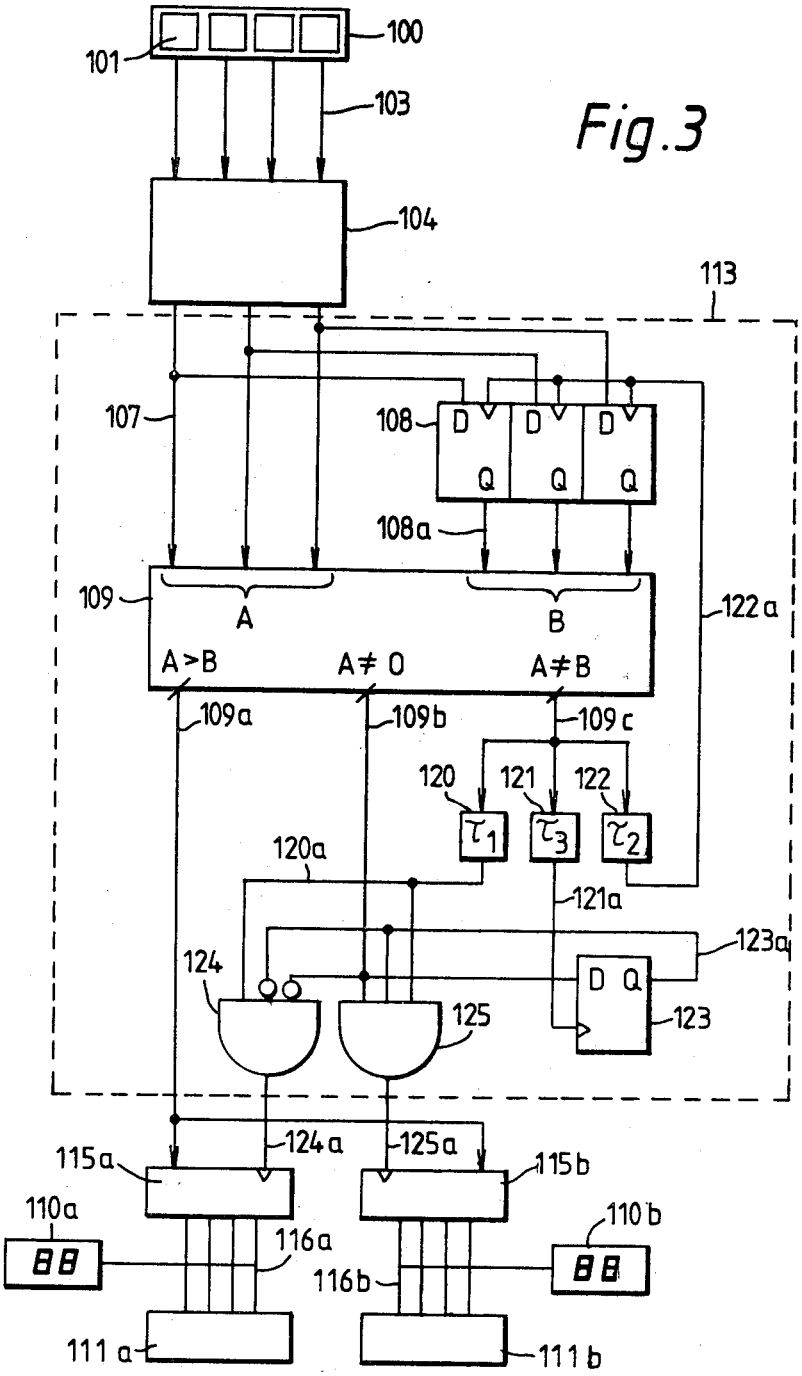
FIG. 3 provides a block diagram of the principle of the electronic circuit associated with the timepiece as shown in FIGS. 1 and 2.

The means employed in the electronic module to correct the one or the other group are explained further on with reference to FIG. 3.

As soon as the main display has been locked on the time signal by means of the measures which have just been explained, the correction mode will be terminated by pressing again on pushbutton 6.

Selection of the functional mode

Field 16 of FIG. 1 shows on two superposed lines the various functions possible and which may be adjusted in the timepiece. In the timepiece considered as example will be found in the upper line and from left to right symbols indicating successively the following functions: chronograph, count-down timer, alarm 1 and alarm 2; in the lower line and from left to right are to be found an acoustic time signal, diaries 1 and 2, the time zone and the date. FIG. 1 illustrates the watch presently in date mode and the sign D is surrounded by a frame 17. On the auxiliary display appear the day of the week at 13 (FR=Friday), the month at 14 (1=January) and the date at 15 (the 25th). Should one wish to have appear on the auxiliary display another function, for example that of diary 1 shown in FIG. 2, the finger will be moved at speed $v_1$ from right to left over the sensor 100 until frame 17 surrounds the sign A G 1. At this instant upon removing the finger from the sensor the frame will begin to blink. During the blinking time which might be set to be between 3 and 4 seconds for example, one may actuate pushbutton 6 which will cause the desired function to appear on the auxiliary or secondary display. It is to be noted that if pushbutton 6 is not actuated during the above-mentioned time lapse the frame will return to its original position (to that shown in FIG. 1). Set to its new function the display indicates at 20 the sign A 1 signifying "diary 1", at 21 "month" and at 22 the "date". In the watch considered as an example this diary indication will automatically appear on the auxiliary or secondary display whatever may be the date otherwise displayed by this display, during twenty-four hours, at the moment when the calendar date coincides with the diary date. It should be remembered here that the choice of the functional mode is obtained by moving the finger at the speed $v_1$ over the sensor, the rapid speed $v_3$ having no influence on such choice.

Correction of the auxiliary display

To enter the correction mode for the auxiliary or secondary display, actuation of pushbutton 6 is required.

In the case as shown in FIG. 1 and following a first actuation of pushbutton 6, groups 14 and 15 blink together. The timepiece is then set to the date (group 15) by moving the finger at speed $v_1$ over the sensor and to the month (group 14) by moving at speed $v_3$ as has been explained in the case of correction of hours and minutes. A second actuation of pushbutton 6 causes the group 13 representing the day of the week to blink which may then be changed by moving the finger at speed $v_1$ over the sensor. A third actuation of pushbutton 6 will remove the entire display 12 from the correction mode and it will even erase the month indication 14 which is no longer desired.

Figure 2:
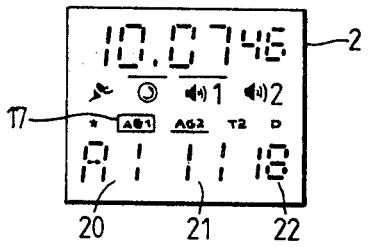
FIG. 2 is a top view of the display of the same timepiece operating in a second mode.

In the case of FIG. 2 one may act in the same manner on sensor 100 and on pushbutton 6 in order to correct groups 21 (month) and 22 (date) of the diary. Actuation of pushbutton 6 will bring the diary function into the correction mode, this effecting blinking of groups 21 and 22 together, while a further actuation will remove the display from this correction mode.

The various manipulations necessary to correct the indications given by the timepiece have been explained above. The means employed according to the invention to correct one group of data rather than another based on the different speeds of movement of the finger over the sensor are now to be described having reference to FIGS. 3, 4 and 5.

FIG. 3 shows the basic block diagram of the electronic circuit associated with the timepiece shown in FIGS. 1 and 2.

According to the patent application cited hereinabove, this circuit comprises a digital sensor 100 provided with N juxtaposed electrodes 101. Outputs 103 are associated with each of electrodes 101. The electrodes 101 of sensor 100 provide binary coded information to the outputs 103 representing the position of the finger on the sensor. The N electrodes 101 of such a sensor permit defining of 2 N−1 positions of the finger, i.e. 2 N−1 coded output information items, independently of the width of the finger. There are thus N positions corresponding to the N electrodes to which may be added N−1 positions taken respectively between each two adjacent electrodes. The 2 N−1 coded information items, provided by N bits may be transformed to M bits with M<N in order to simplify the electronic circuit associated therewith and to eliminate the effect of the finger width. A transformation circuit is represented at 104 and receives at its input 103 the N bits provided by the sensor and provides at its output a code reduced to three bits 107.

In accordance with the invention the outputs 107 of the transformation circuit (transcoder) are coupled to the input of a logic circuit 113, certain elements of which are arranged according to the cited patent application and which furnishes at its output clock pulses 124*a*, 125*a* respectively to the input of a first (115*a*) or to a second (115*b*) counter according to the speed of movement of the finger, and a control signal 109*a* controlling the counting sense of said counters. Outputs 116*a* and 116*b* of each of the counters feed utilization circuits 111*a*, 111*b* and the displays 110*a*, 110*b* relating thereto respectively.

The logic circuit 113 includes as in the case of the previously cited patent application a comparator circuit 109 which may be of the type 74 C 181 for example, to the inputs A entry of which are directly coupled outputs 107 of the transcoder 104 and to the inputs B entry of which via three D flip-flops 108 are coupled delayed outputs 107. The three outputs 109*a*, 109*b* and 109*c* of the comparator assume the logic state 1 when the conditions at the input are respectively A>B, A≠0 and A≠B. It is noted that the input A of circuit 109 represents the actual position of the finger on the sensor and the input B the immediately preceding position of the finger on the sensor. From this fact:

(a) when condition A≠0 is obtained the finger is in contact with the sensor, (b) when the condition A>B is obtained the finger has been displaced towards the left. When not obtained it has been displaced towards the right or not changed position. This therefore defines the sense of counting of the reversible counters 115*a* and 115*b*, (c) when condition A≠B is obtained there has been a movement of the finger over the sensor.

The logic circuit 113 furthermore and according to the invention comprises three delay timing circuits 120, 121 and 122 having respective delays of $\tau_1$, $\tau_3$ and $\tau_2$; AND gate 124 which is enabled if signals to the two inhibit inputs are at the 0 state with the direct input at the 1 state; AND gate 125 which is enabled if its three inputs are at the 1 state and a D flip-flop of the type D 123. All these elements are arranged according to the invention as shown in the block diagram of FIG. 3. It should be noted that the AND gates are well-known from the state of the art and that the timing circuits may be formed for instance each one by two integrated circuits of the type 555 coupled in series.

To consolidate the ideas already presented it will be supposed that the timepiece which has been earlier described above shows on its auxiliary display, the function diary 1 for which the month and the date are to be entered (see FIG. 2). To the group 21 (month) corresponds reversible counter 115*a* to the group 22 (date) corresponds the reversible counter 115*b*. The month is displayed at 110*a* and stored at 111*a*; the date is displayed at 110*b* and stored at 111*b*. Two cases may occur:

1. Date correction

According to the invention the finger should be moved at a speed $v_1$ less than the threshold speed $v_2$ over the sensor in order to correct the group of digits representing the date (display 110*b*).

When the finger enters into contact with one of the electrodes 101 of sensor 100 it will introduce at the input of comparator 109 a new coded value. As long as the D flip-flop 108 has not received the clock pulse it will maintain at outputs Q, corresponding to the coded value B at the second input of the comparator 109 the present value of A present before the contact of the finger on the sensor. The instant of contact is shown by $t_a$ on FIG. 4 which represents the operation of the arrangement during movement at slow speed $v_1$. At this moment A has changed its value which is arbitrarily symbolised in the timing diagram by a line passing from a low state to a high state. At this same moment $t_a$ the condition A≠B is realised and the output 109*c* goes from the 0 state to the 1 state. From this moment on the timing circuits 120, 121 and 122 may generate a short pulse (for instance 2 ms) at the end of each of their respective delays $\tau_1$, $\tau_3$ and $\tau_2$. A short pulse is emitted by the timing circuit 122 following a time $\tau_2$, which is fixed for instance at 30 ms. This pulse via line 122*a* is conducted to the clock inputs of D flip-flop 108 thereby bringing the Q outputs of said flip-flop to the same state as that at its inputs D, and since the value of A has not changed it will be found that A=B and that the output 109*c* goes to 0. This switching is shown by arrow 130 on FIG. 4. It is necessary to note here that in the cited patent application the clock pulses for flip-flop 108 were supplied by an exterior generator at 100 Hz. The system according to this invention presents an interesting improvement through the fact that the clock is internal to the system shown by circuit 113 thereby achieving complete self-synchronisation. The timing circuit 121 is of the type known as retriggerable. It exhibits the particularity of not providing an output so long as its input is at the 1 state. However if its input goes to the 0 state it may provide an output pulse at the end of its delay $\tau_3$, for instance 25 ms, and which begins to be counted at the moment of the changeover to the 0 state. Such situation is shown on the timing diagram of FIG. 4 where it will be noted that a short pulse is emitted on line 121*a* following a delay $\tau_3$, which runs from the moment when the line 109*c* has changed to the 0 state. On line 121*a* of the diagram small crosses are used to symbolize the fact that the timing circuit 121 may not furnish a pulse so long as line 109*c* is in the state 1. A short pulse emitted on line 121*a* by the timing circuit 121 is transmitted to the clock input of the D flip-flop 123. The input D of this flip-flop is connected to the output 109*b* (A≠B) of comparator 109. Since the finger is in contact with the sensor the condition A≠0 is realised and the output 109*b* is in the state 1. This same state 1 will be found at the Q output of the D flip-flop 123 as soon as the leading edge of the short pulse emitted by the timing circuit 121 has appeared. This switching is shown by the arrow 131 on FIG. 4.

It is also seen that to output A≠B is connected a timing circuit 120 which emits at its output 120*a* a short pulse at the end of its delay $\tau_1$, which may for instance be of 25 ms. It may equally be seen that during the period separating $t_a$ from time $t_b$, i.e. as soon as the finger has touched the sensor and rests stationary thereon, gate 125 is never enabled since there is never a coincidence of 1 states on the three inputs via lines 109*b*, 120*a* and 123*a* as shown by the timing diagram of FIG. 4. Line 125*a* remains at the 0 state: no clock signal arrives at counter 115*b* and thus no new value appears on the corresponding display. The arrangement is desirable in practice since it enables avoiding untimely changes which are difficult to control.

As has been mentioned above and in the cited patent application if the sensor is provided with N electrodes it will be possible to obtain a maximum of 2 N−1 coded information items at the output of the transcoder 104 if the finger is moved from one end to the other of the sensor. As has just been explained in the preceding paragraph, it is desired that the first contact of the finger on the sensor will not result in the output of information. From the preferred arrangement according to this invention there will thus only be a maximum of 2 N−2 information items available at the input of counter 115*b*. For instance if the sensor is comprised of four electrodes a movement of the finger from one end to the other thereof will result only in the output of six information items. It is also possible to foresee an arrangement based on like principles whereby information is provided only by the transition between adjacent electrodes, in which case the maximum information items available will be limited to N−1.

If now the finger starts to move on the sensor the moment will arrive when the value of A is about to change state. This moment is indicated on FIG. 4 by the time $t_b$. From this moment the fact that A is different from B will result in a state 1 on line 109*c*. As the lines 109*b* (the condition A≠B is still present) and 123*a* are at the state 1 gate 125 will be enabled as soon as its input to which is connected line 120*a* goes to state 1. This arrives after the delay $\tau_1$. This situation is illustrated on FIG. 4 at time $t_x$. The pulse appearing on line 125*a* may then add or subtract a single unit from the date counter 115*b* (according to whether A>B or that A<B). Several other clock pulses may thus arrive at counter 115*b* if the finger continues to move over the sensor.

At the moment when the desired symbol appears on the display, such symbol possibly being a digit, a letter or any special sign, the finger must leave the sensor in order that the data be definitely fixed either in the utilization circuit 111*b* or in the corresponding display 110*b*. This instant is indicated by time $t_c$ on the timing diagram of FIG. 4. Since the finger is no longer in contact with the sensor the condition A≠0 is no longer realised and line 109*b* passes to the state 0. The short pulse appearing on line 120*a* at the end of delay $\tau_1$ cannot traverse gate 125 since input 109*b* is at the state 0. A short pulse appearing on line 121*a* places the Q output (123*a*) of D flip-flop 123 in the same state as its D input i.e. at the state 0 since once again the condition A≠0 is no longer realised (arrow 132). Thus in lifting the finger from the sensor new information is neither added nor subtracted in the counter 115*b* which is an advantage evidently desirable in practice.

Figure 4:
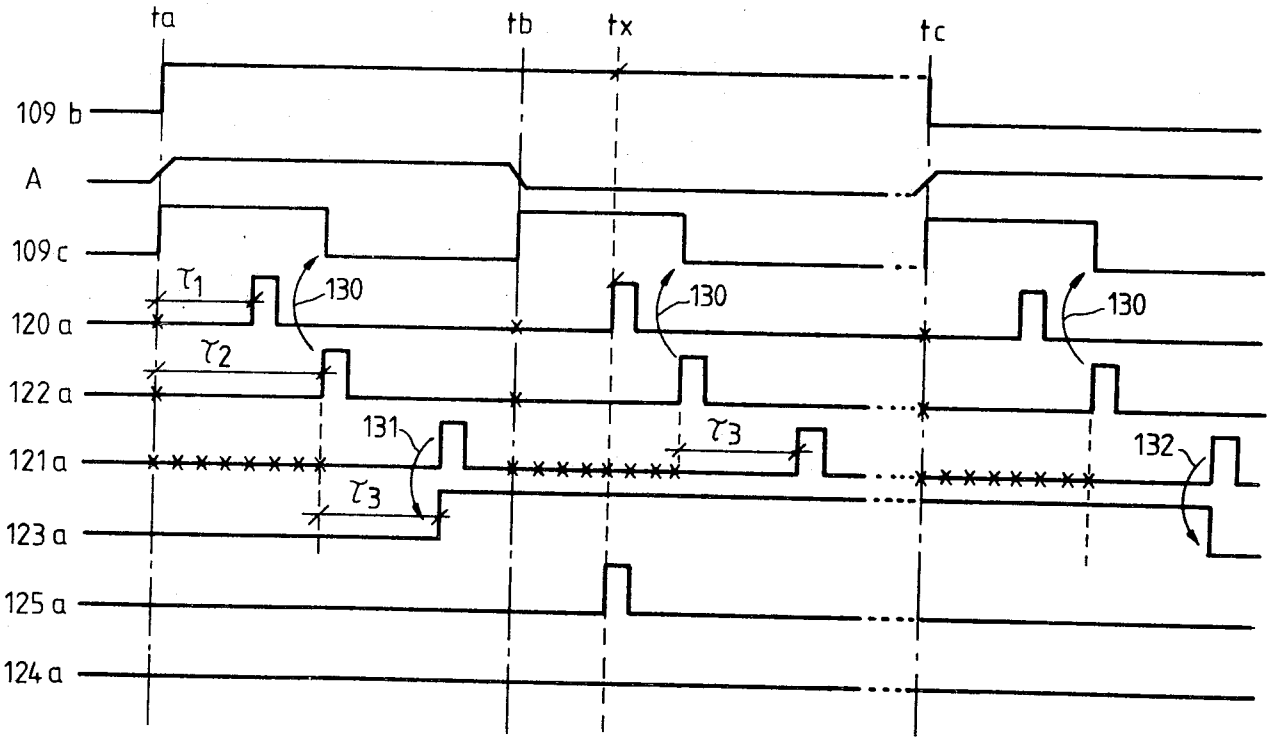
FIGS. 4 and 5 are timing diagrams explaining the functioning of the electronics as represented in FIG. 3.

The timing diagram of FIG. 4 shows also that counter 115*a* to which corresponds the display of months never receives clock pulses. In order that the contrary should happen it would be necessary that at a certain moment line 120*a* would be at state 1 while at the same time lines 123*a* and 109*b* were at the state 0. This situation however never arrives in the slow cycle which has just been described and as shown by the timing diagram.

2. Month correction

According to the invention the finger must move at a speed $v_3$ greater than the threshold speed $v_2$ over the sensor in order to correct the group of digits representing the month (display 110*a*).

Figure 5:
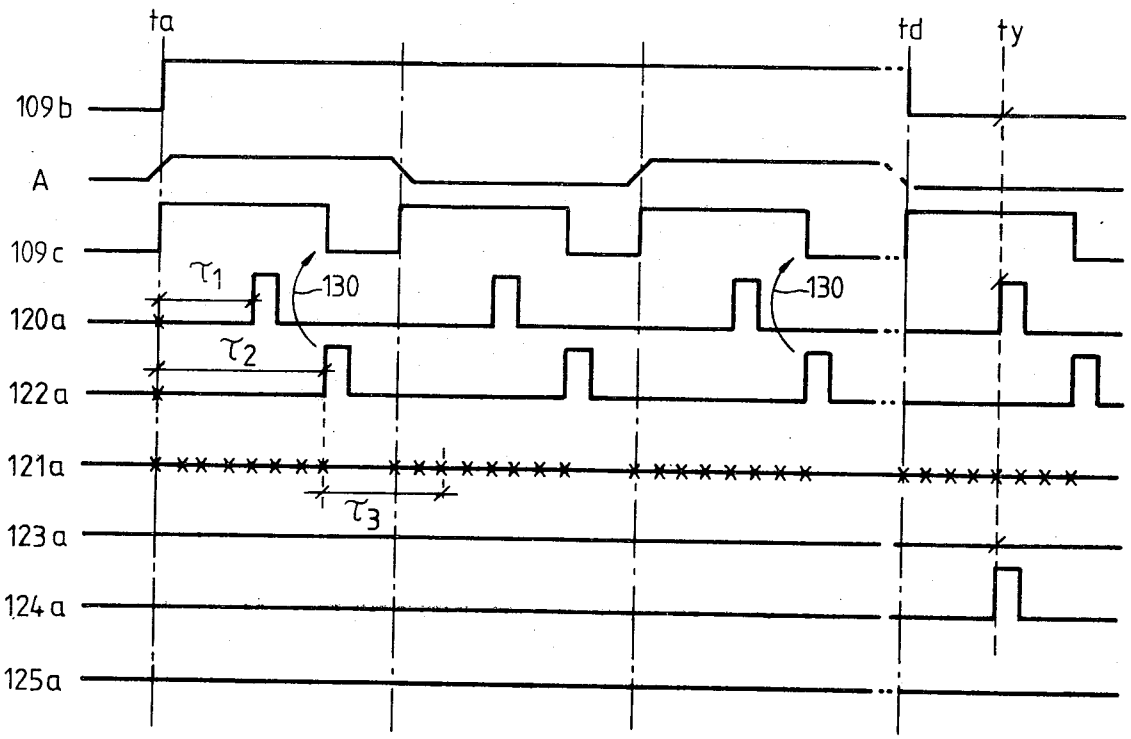

Reference should be made to the timing diagram of FIG. 5 in order to understand the operation of the arrangement. At time $t_a$ the finger comes in contact with the sensor, this bringing about as in the case of date correction, change to state 1 also of line 109*b* (A≠0) and of line 109*c* (A≠B). As before, short pulses issued from the timing circuits 120 and 122 appear on lines 120*a* and 122*a*. It was seen above that the short pulse coming from timing circuit 121 appears on line 121*a* at the end of its delay $\tau_3$ if line 109*c* is at the state 0. In the case with which we are now concerned, the speed of movement of the finger over the sensor is so high that when the end of delay $\tau_3$ arrives line 109*c* is already at the state 1. No pulse appears thus on line 121*a*. When the finger leaves the sensor at the moment $t_d$ the condition A≠0 is no longer satisfied and line 109*b* passes to state 0. The short pulse given by the timing circuit 120 appears normally at the end of its delay $\tau_1$. Line 123*a* is at state 0 since no pulse has been applied thereto by 121 via the D flip-flop 123. Thus all the conditions are present to enable gate 124 which emits via line 124*a* a pulse to the month counter 115*a*. This arrangement is shown on FIG. 5 at time $t_y$.

It will be understood that counter 115*b* to which the date display corresponds does not receive a clock pulse in the case under consideration. Effectively in order that this should be the case it would be necessary that at a certain moment lines 120*a*, 123*a* and 109*b* be at the state 1 which is not the case as is illustrated by the timing diagram of FIG. 5.

It may also be seen through examination of FIG. 5 that at high speed there can be only one clock signal 124*a* for one passage of the finger over the sensor since the signal appears only when the finger leaves the sensor and provided that it has maintained its high speed. This is a requirement imposed by practice for if, as in the correction mode at slow speed, one could at high speed and with a single movement introduce several corrections the arrangement would be totally lacking in precision and lengthy operations would be necessary in order to stop at the desired value. If during its movement the speed of the finger should descend below the threshold speed $v_2$, the situation again will be as explained with reference to FIG. 4. It will be also noted that in order to enter the correction mode for counter 115*a* (month) it is necessary to contact the sensor at high speed. If such were not the case (low speed or 0) the timing circuit 121 will emit a pulse at the end of its delay $\tau_3$, this having as consequence the enabling of counter 115*b* (date) as has been explained with reference to FIG. 4. Next, if the speed of the finger were to increase above the threshold speed $v_2$ during the same movement the situation of the timing diagram of FIG. 5 will never arrive since line 123*a* will be at the state 1, this preventing the enabling of gate 124. This constitutes an advantage since it prevents differences in speed during a single traverse sometimes to act on one counter and sometimes on the other.

3. Considerations common to both corrections

The choice of corrections between one group of digits and another depends, as one has seen, on the speed with which the finger is moved over the sensor. If it is moved slowly one group of digits will be corrected and with as many as six corrections for a single traverse. If it is moved rapidly another group of digits will be corrected and with a single correction for each traverse.

The threshold speed $v_2$ which is between the slow speed $v_1$ and the high speed $v_3$ is determined by the longitudinal dimension of the sensor. It has been seen that the presence or absence of the short pulse from the timing and delay circuit 121 at the end of its delay $\tau_3$ conditions the correction of one group to the exclusion of the other or vice versa. The delay $\tau_3$, starting at the end of delay $\tau_2$, the time to be taken into consideration for the threshold speed is thus $\tau_2+\tau_3$. In a practical example of the invention the distance separating two coded information items on the sensor is 2.25 mm. In the same manner it has already been mentioned that the delays $\tau_2$ and $\tau_3$ are chosen respectively to be 30 and 25 ms, this giving for $\tau_2+\tau_3$ a period of 55 ms. Under these conditions the threshold speed $v_2$ is on the order of 4 cm/sec.

It must also be recalled that in both cases counters 115*a* and 115*b* may be augmented or diminished by line 109*a* ($A>B$ or $A<B$) in accordance with the sense of movement of the finger from left to right or from right to left.

In conclusion it may be mentioned that the reversible counters 115*a* and 115*b* may be obtained through the use of standard circuits known from the state of the art such as the type 4029. More generally these could also be in a micro-processor for which the soft-ware is arranged to provide an equivalent to what is normally expected from a standard counter.

We claim:

1. An interface device for the entry of data into an instrument of small volume such as a timepiece comprising a static touch responsive sensor arranged to be manually actuable with each position of a finger corresponding to at least one symbol which may take the form of a number, letter or special sign, said sensor being formed by the juxtaposition of N electrodes adapted to provide at least $N-1$ coded information items representative of the position of the finger on the sensor and wherein are provided a sense/speed detecting means, coupled to the sensor for receiving signals therefrom and interpreting the signals to detect the sense and the speed of movement of the finger over the sensor, generating means for generating signals representing data to be selected or modified coupled to a display means for displaying symbols representative of the data on a composite display device comprising at least a first and a second displays, said generating means being coupled to said sense/speed detecting means for receiving signals therefrom for modifying the data controlling symbols appearing on said first display if the finger is moved over said sensor at a speed less than a predetermined speed and on said second display if the finger is moved over said sensor at a speed greater than said predetermined speed.

2. An interface device as set forth in claim 1 wherein the sense/speed detection means comprises a switching means and said generating means comprises first and second counters for said first and second displays respectively, said switching means having the function of switching information items to the first counter if the finger is moved over the sensor at a speed $v_1$ less than a threshold speed $v_2$, or to the second counter if the finger is moved over the sensor at a speed $v_3$ greater than the threshold speed $v_2$ whereby the first or second displays are modified to display the symbols corresponding to the information items.

3. An interface device as set forth in claim 2 wherein the first and second displays of the composite display device provide four juxtaposed symbols arranged in first and second groups of two, the first group being modified when the finger is moved at the speed $v_1$ and the second group modified when the finger is moved at the speed $v_3$.

4. An interface device as set forth in claim 3 wherein the data generated by said generator means is related to time and wherein the first group is adapted to display hours and the second group to display minutes, the movement of the finger thereby effecting hour and minute setting of a timepiece.

5. An interface device as set forth in claim 3 wherein the data generated by said generator means is related to dates and wherein the first group is adapted to display the month and the second group to display the date, the movement of the finger thereby effecting month and date setting of a timepiece.

6. An interface device as set forth in claim 2 wherein the sense/speed detecting means includes a first output providing first clock pulses to an input of the first counter and a second output providing second clock pulses to an input of the second counter in accordance with the speed of finger movement.

7. An interface device as set forth in claim 2 wherein said sense/speed detecting means has the additional function of only affecting the symbols displayed on the first display corresponding to the finger position if the finger moves over the sensor at said speed $v_1$ and of only affecting the symbols displayed on the second display if the finger moves over the sensor at said speed $v_3$, with the first and last electrodes of said sensor being respectively accosted and departed at a speed substantially equal to said speed $v_3$.

8. An interface device as set forth in claim 6 wherein the sense/speed detecting means includes a comparator of at least M bits capacity having first inputs arranged to receive coded signals directly from the sensor and second inputs arranged to receive said coded signals from the sensor via a delay creating circuit, said comparator providing three possible output signals in accordance with the comparison between the signals received at the first and second inputs, a first output signal representing the sense of finger movement over the sensor and constituting a control signal determinative of up or down counting, a second output signal being indicative of finger contact with the sensor and a third output signal indicative of finger movement over the sensor, the second and third output signals being combined in gates so as to form the clock pulses directed to the first or second counter as determined by the speed of movement of the finger over the sensor being respectively less or greater than the threshold speed $v_2$.

9. An interface device as set forth in claim 8 wherein the delay creating circuit comprises a D type flip-flop arranged to receive the third output signal of the comparator at its clock input, said third comparator output signal being delayed by a first delay timing element.

10. An interface device as set forth in claim 9 wherein in order to provide the clock input of the generating-means first counter the sense/speed detecting means includes a first AND gate having three inputs, the first of which is coupled to the third output signal of the comparator via a second delay timing element, the second of which is coupled to a Q output of a D flip-flop controlled at its clock input by said comparator third output signal transmitted via a third delay timing element, and the third of which is coupled to the second output signal of the comparator the latter being further coupled to the D input of said D flip-flop.

11. An interface device as set forth in claim 10 wherein in order to provide the clock input of the generating-means second counter the sense/speed detection means includes a second AND gate having three inputs, the first of which is coupled to the output of the second delay timing element, the second of which receives an inverted Q output signal of said D flip-flop and the third of which receives an inverted second output signal of the comparator.

12. An interface device as set forth in claim 10 wherein the third delay timing element comprises a retriggerable monostable element means for having a time constant $\tau_3$ which runs from the moment at which a signal appears at the output of the first delay timing element.

13. An interface device as set forth in claim 1 wherein the instrument comprises a wrist-watch.

* * * * *